US008297193B1

(12) United States Patent
Lawson et al.

(10) Patent No.: US 8,297,193 B1
(45) Date of Patent: Oct. 30, 2012

(54) SURROGATE RPG

(75) Inventors: William R. Lawson, South Hamilton, MA (US); Scott Paul Quigley, Stoughton, MA (US); Jamie Orlando Milliken, Waltham, MA (US); Robert Lee Cardenas, Framingham, MA (US)

(73) Assignee: Foster-Miller, Inc., Waltham, MA (US)

( * ) Notice: Subject to any disclaimer, the term of this patent is extended or adjusted under 35 U.S.C. 154(b) by 0 days.

(21) Appl. No.: 13/135,554

(22) Filed: Jul. 8, 2011

(51) Int. Cl.
*F42B 8/12* (2006.01)

(52) U.S. Cl. ..... 102/498; 102/216

(58) Field of Classification Search ..... 102/395, 102/397, 498, 500, 529, 502, 293, 444, 488, 102/216; 42/1.08; 89/6, 6.5; 434/11
See application file for complete search history.

(56) References Cited

U.S. PATENT DOCUMENTS

| | | | | |
|---|---|---|---|---|
| 2,485,887 | A * | 10/1949 | Jordan | 102/499 |
| 2,887,056 | A * | 5/1959 | Perret | 102/216 |
| 3,810,426 | A * | 5/1974 | Baker | 102/513 |
| 5,157,221 | A * | 10/1992 | Ronn | 102/216 |
| 5,222,798 | A * | 6/1993 | Adams | 362/110 |
| 5,970,876 | A * | 10/1999 | Haglund | 102/216 |
| 6,311,605 | B1 | 11/2001 | Kellner et al. | |
| 6,604,946 | B2 * | 8/2003 | Oakes | 434/11 |
| 7,441,505 | B1 * | 10/2008 | Rodgers, Jr. | 102/513 |
| 8,152,323 | B2 * | 4/2012 | Bushee | 362/112 |
| 2007/0001809 | A1 | 1/2007 | Kodukula et al. | |
| 2008/0164379 | A1 | 7/2008 | Wartmann et al. | |
| 2009/0217811 | A1 | 9/2009 | Leeming | |
| 2009/0266226 | A1 | 10/2009 | Beach et al. | |
| 2009/0266227 | A1 | 10/2009 | Farinella et al. | |

FOREIGN PATENT DOCUMENTS

| | | | |
|---|---|---|---|
| DE | 691067 | | 4/1940 |
| EP | 166074 | A2 * | 1/1986 |
| WO | WO 2006/134407 | | 12/2006 |
| WO | WO 2006/135432 | | 12/2006 |
| WO | WO 2008/079001 | | 7/2008 |

* cited by examiner

*Primary Examiner* — Michael Carone
*Assistant Examiner* — Reginald Tillman, Jr.
(74) *Attorney, Agent, or Firm* — Iandiorio Teska & Coleman, LLP

(57) ABSTRACT

A surrogate RPG includes a warhead with an outer conductive portion and an inner conductive portion spaced from the outer conductive portion. A sabot includes an electrical circuit configured to monitor conductivity between the inner and outer conductive portions. The surrogate RPG can be used to test the effectiveness of various RPG defeat technologies.

17 Claims, 9 Drawing Sheets

SURROGATE RPG

FIELD OF THE INVENTION

This invention relates to testing of shield technologies.

BACKGROUND OF THE INVENTION

Various technologies have been developed in an attempt to protect vehicles and structures from rocket propelled grenades (RPGs) and other threats. During the Vietnam war, chain link fencing was attached to tanks in an attempt to dud RPGs so they wouldn't detonate. See also German Patent DE 691,067. Nets have also been suggested as a technology used to strangulate the nose cone or ogive of an RPG. See U.S. Patent Publication Nos. 2007/01809A3 and 2009/0266227 incorporated herein by this reference. Other shield technologies include U.S. Pat. No. 6,311,605; and published application nos. 2009/0266226; WO2006/135432; WO2006/134407; U.S. 2009/0217811; WO2008/079001; US 2008/0164379.

Testing the effectiveness of these and other technologies may require live firings of actual RPGs at the shield. Such testing efforts require special facilities and may involve the use of numerous actual RPGs resulting in safety and cost concerns.

SUMMARY OF THE INVENTION

It is therefore an objective in one aspect of the subject invention to provide, in one preferred embodiment, a surrogate RPG which is at least partially reusable and which is safer and less costly than using actual RPGs in test firings. The proposed surrogate RPG enables fairly accurate testing of various RPG defeat technologies against various threat types and allows the design of a given RPG defeat technology to be improved.

This invention features a surrogate RPG comprising a warhead with an outer conductive portion and an inner conductive portion spaced from the outer conductive portion. A sabot typically includes an electrical circuit configured to monitor conductivity between the inner and outer conductive portions.

The electrical circuit preferably includes a power source electrically connected to the outer and inner conductive portions via an indicator such as an LED lamp. The outer conductive portion and the inner conductive portion are typically cone shaped. Also, the outer cone shaped conductive portion may include markings dividing the outer conductive cone shaped portion into sections. A base section may also be included.

An insulative spacer is usually installed between the outer conductive portion and the inner conductive portion. There is also, in one embodiment, a support structure for the outer conductive portion, a support structure for the inner conductive portion, and a dummy fuse attached to the outer conductive portion.

One surrogate RPG in accordance with the invention features a warhead including an outer conductive portion and an inner conductive portion spaced from the outer conductive portion and an electrical circuit configured to monitor conductivity between the inner and outer conductive portions. A sabot may be included and it typically houses the electrical circuit.

This invention also features a method of making a surrogate RPG. One method comprises fabricating an outer conductive warhead portion, fabricating an inner conductive warhead portion, placing the inner conductive warhead portion inside the outer conductive warhead portion in a spaced relationship with respect to the outer conductive warhead portion, and installing an electrical circuit configured to monitor conductivity between the inner and outer conductive portions. Installing the electrical circuit may include electrically connecting a power source to the outer and inner conductive portions via an indicator.

This invention also features a method of evaluating the effectiveness of an RPG shield. One method comprises firing a surrogate RPG at an RPG shield, the surrogate RPG including an outer conductive portion spaced from an inner conductive portion. The RPG is imaged as it strikes the RPG shield. The resultant images are reviewed to determine if conductivity between the inner and outer conductive portions changed during the firing.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
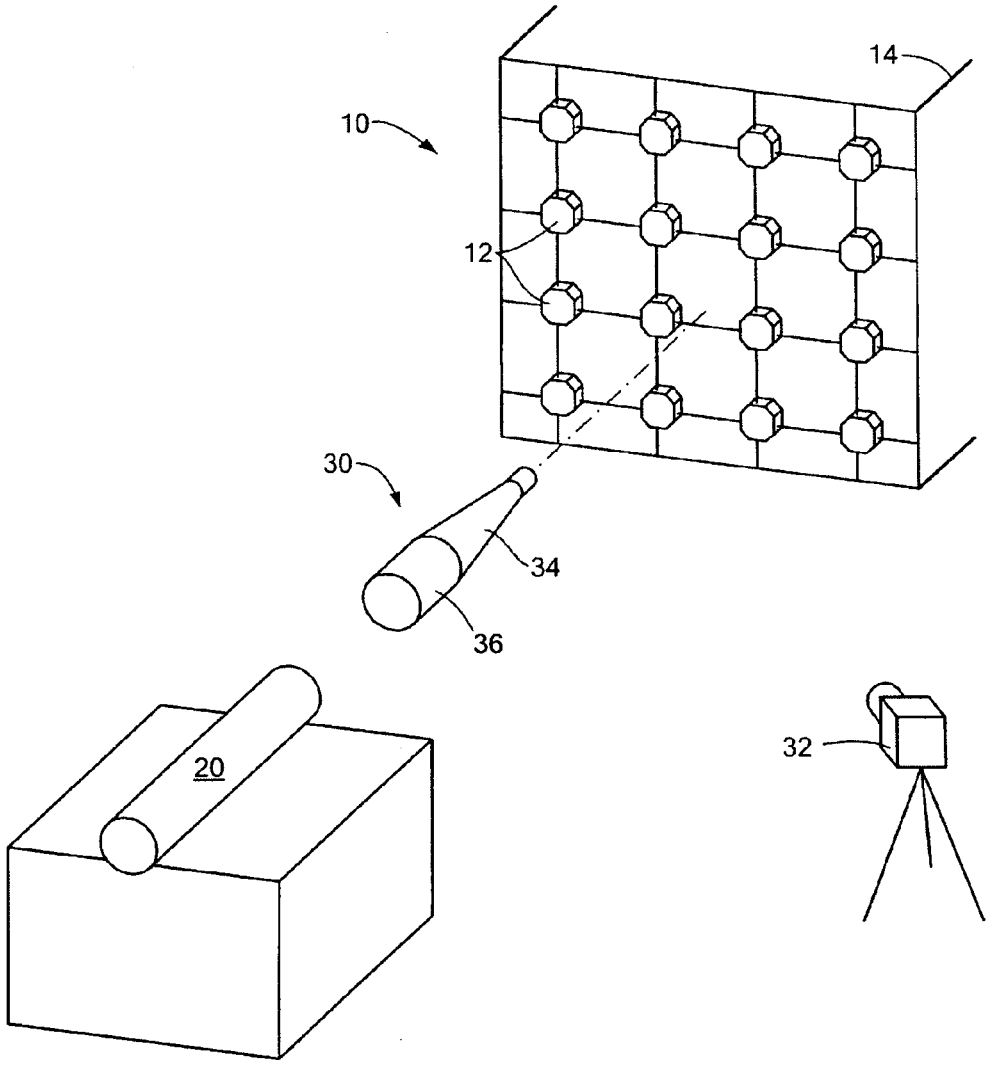
FIG. 1 is a schematic depiction showing the use of a surrogate RPG to test the effectiveness of a particular RPG defeat technology in accordance with an example of the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 depicts a test setup or test bed including RPG shield subsystem 10 including, for example, net material on a frame 14 supporting hard points 12 as shown in published application No. U.S. 2009/0266227 incorporated herein by this reference.

Air cannon 20 launches surrogate RPG 30 at RPG shield 10 while one or more high speed video cameras 32 record the results. Surrogate RPG 30 includes, in this example, as better shown in FIG. 2, warhead portion 34 and sabot portion 36. Warhead portion 34 includes outer conductive cone member 38*a* and inner conductive cone member 38*b* spaced and insulated from outer conductive cone member 38*a*. The bases of both cone members are removeably secured to sabot 36.

In one example, outer cone 38*a* is made of series 2024 aluminum and inner cone 38*b* is made of series 1100 aluminum. Sabot 36 typically includes an electrical circuit configured to monitor the conductivity between the inner 38*b* and outer 38*a* conductive cones. When a portion of outer cone 38*a* comes into electrical contact with a portion of inner cone 38*b*, one or more indicator lamps 40*a-c* are energized indicating a defeat of the surrogate RPG.

Thus, when the surrogate RPG is fired as shown in FIG. 1 and one or more hard points 12 of net subsystem 10 tear into the outer cone, a portion of the outer cone will come into electrical contact with the inner cone and thus the monitoring circuitry will detect the change in conductivity between the outer and inner conducive cones and provide an indication corresponding to a defeat of the RPG and the effectiveness of the net shield. Alternatively, one or more hard points will electrically couple the outer cone to the inner cone and the monitoring circuitry will again provide an indication.

If the firing of the surrogate RPG does not result in either a strangulation of the nose cone portions or a physical touching of a portion of the outer cone with the inner cone, then the outer cone will remain insulated with respect to the inner cone and no indication will be provided.

Figure 2:
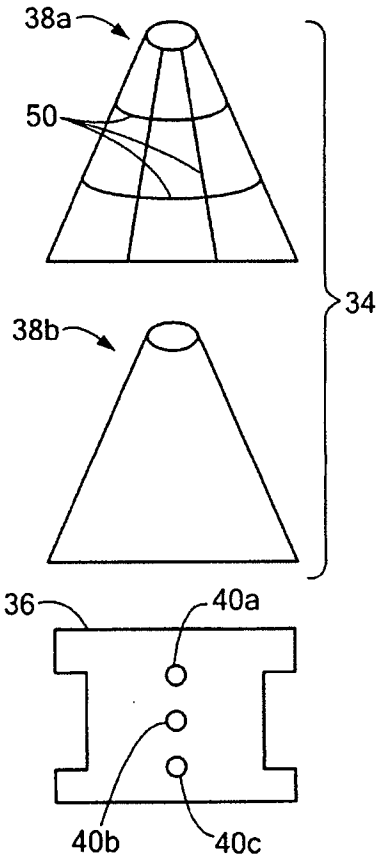
FIG. 2 is a highly schematic view showing an example of a surrogate RPG in accordance with the subject invention.

Video camera 32 can be used to monitor when the appropriate indicator has been energized and can also be used, in connection with markings 50, FIG. 2 on the outside of outer cone 38*a*, to determine where a hard point struck the RPG warhead, the extent of any tearing caused by the hard point, and the like. While watching the surrogate firing video in slow motion, the effectiveness of the RPG shield can be analyzed. Multiple firings can be made by reusing sabot portion 36 and replacing any damaged outer and/or inner cones 38*a* and 38*b*. The video footage can also be used to determine the speed of the surrogate RPG.

In this way, the effectiveness of various shield designs can be more reliably determined. For example, in the hard point system shown in FIG. 1, various hard point weights and configurations can be tested, different net geometries can be evaluated, and the like. Different RPGs can also be modeled as can the effectiveness of a shield depending upon the angles the surrogate RPGs strike the shield.

The result is a surrogate RPG in this embodiment which is at least partially reusable and which is safer and less costly than testing techniques employing actual RPGs. A surrogate RPG enables fairly accurate testing of various RPG defeat technologies and allows the design of a given RPG defeat technology to be improved.

Figure 3B:
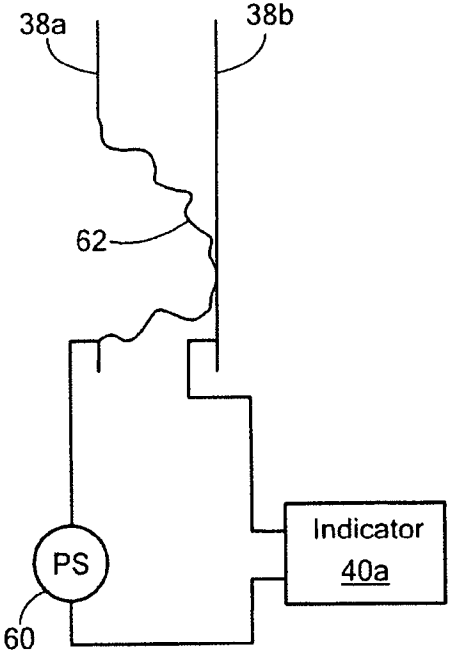
FIG. 3B is a wiring diagram as shown in FIG. 3A but now after firing of the surrogate RPG.
Figure 3A:
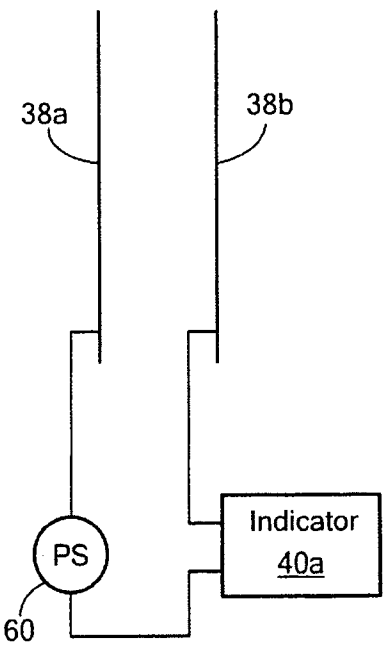
FIG. 3A is a wiring diagram for an electrical circuit incorporated into the surrogate RPG shown in FIG. 1 before firing.

FIG. 3A shows one example of the monitoring circuitry discussed above which includes power source 60 (e.g., a battery) electrically connected to outer warhead cone 38*a* and inner cone 38*b* via indicator 40*a* (e.g., a LED). Due to the gap between outer cone 38*a* and inner cone 38*b* in FIG. 3A, indicator 40*a* is not energized. In FIG. 3B, however, net shield 10, FIG. 1 has been effective and one or more hard points 12 has dug into outer cone 38 causing a portion of it as shown at 62 to touch and make electrical contact with inner cone 38*b*. Power source 60 now energizes indicator 40*a* which is viewed during a slow motion replay of the video taken by video camera 32, FIG. 1. Additional indicators may be provided as shown in FIG. 2 including a back-up indicator (40*b*) and a power on indicator (40*c*). If during a test firing one or more hard points 12, FIG. 1 does not cause any portion of outer cone in 38*a* to electrically contact inner cone 38*b*, indicator 40*a* will not be illuminated and the test result will be that the RPG "detonated." Strangulation type net systems and other shield systems can be evaluated in the same manner.

Figure 4:
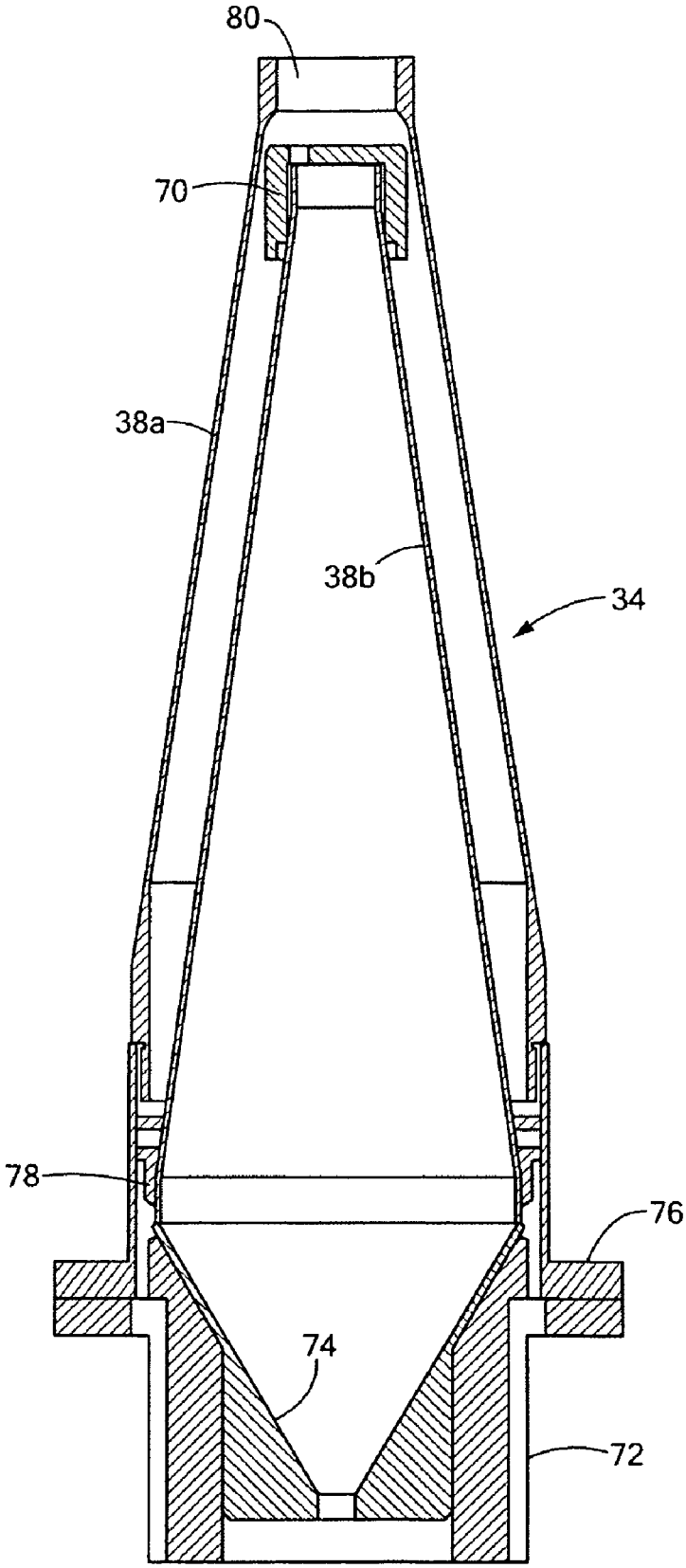
FIG. 4 is a schematic cross-sectional front view showing the primary components associated with an example of a surrogate RPG in accordance with the subject invention.
Figure 6:
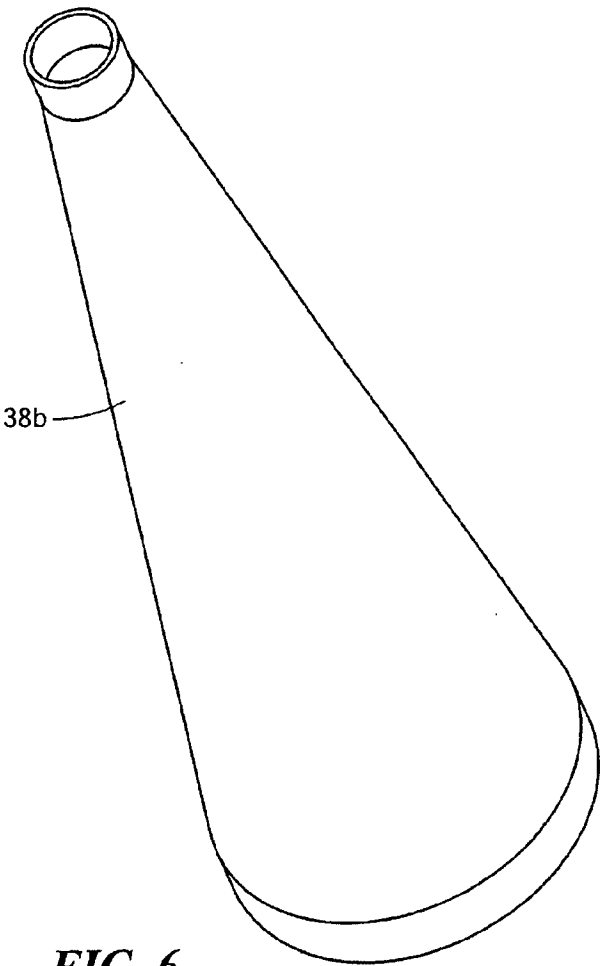
FIG. 6 is a schematic three-dimensional front view of the inner conductive cone of the RPG shown in FIG. 4.
Figure 5:
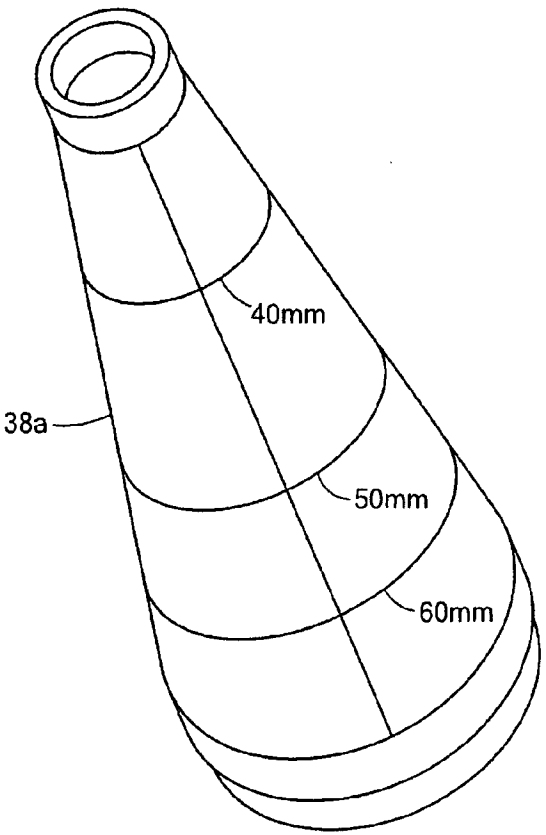
FIG. 5 is a schematic three-dimensional front view showing the outer conductive cone of the surrogate RPG shown in FIG. 4.
Figure 7A:
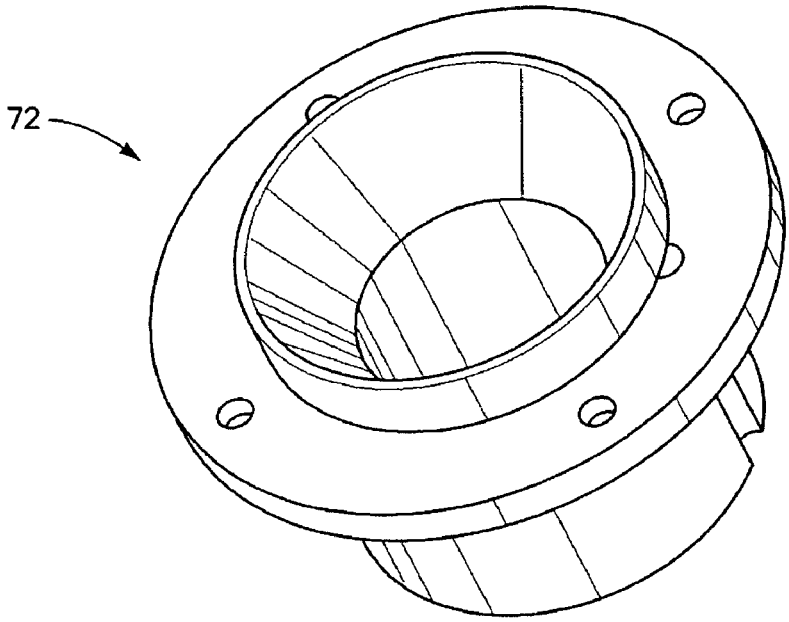
FIG. 7A is a three dimensional top view of the inner cone support component of the RPG shown in FIG. 4.
Figure 7B:
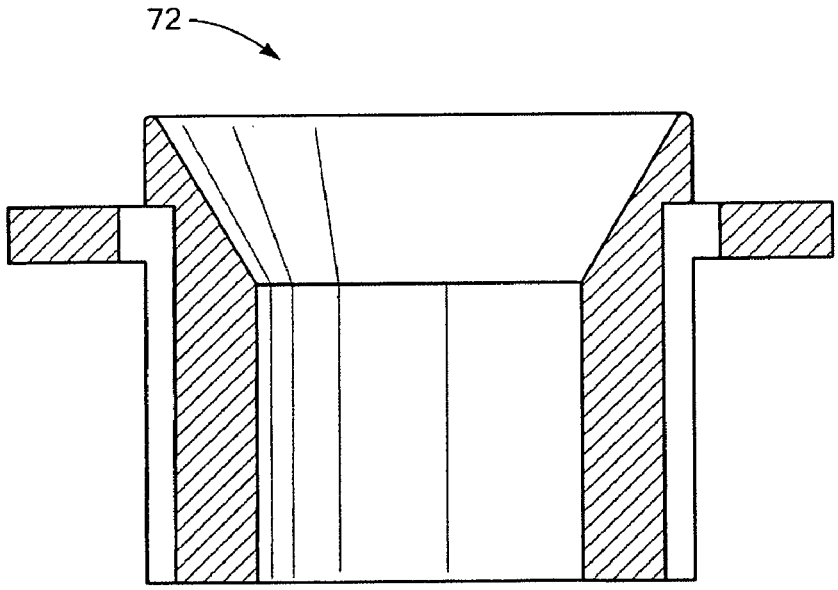
FIG. 7B is a cross sectional view of the inner cone support component shown in FIG. 7A.
Figure 8A:
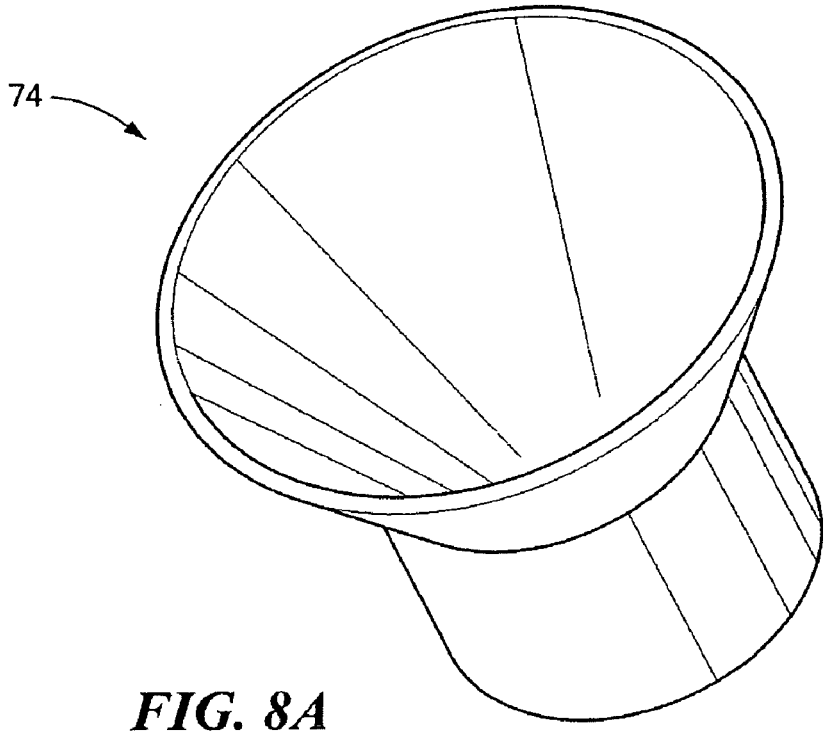
FIG. 8A is a schematic three dimensional top view of a liner component for the RPG shown in FIG. 4.
Figure 8B:
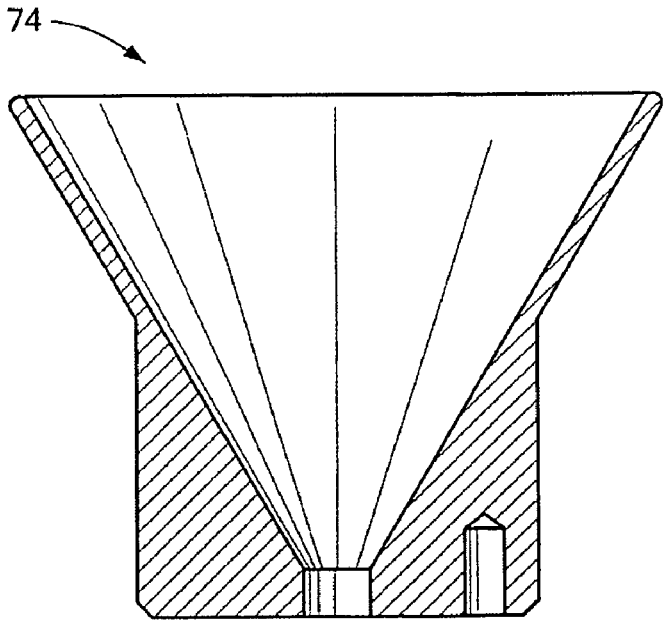
FIG. 8B is a schematic cross sectional front view of the liner component shown in FIG. 8A.
Figure 9A:
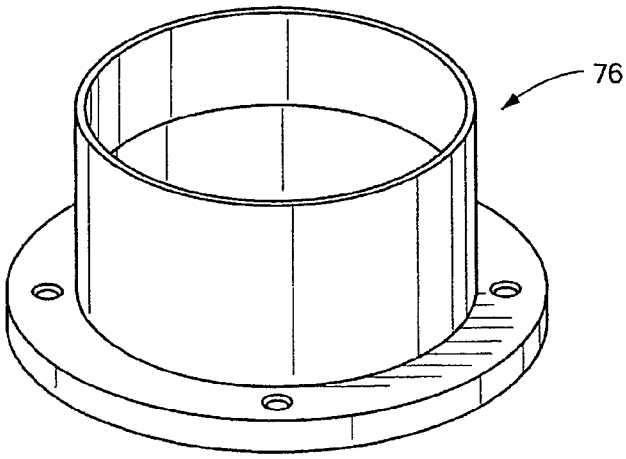
FIG. 9A is a schematic three dimensional view showing the outer cone holder component for the surrogate RPG shown in FIG. 4.
Figure 9B:
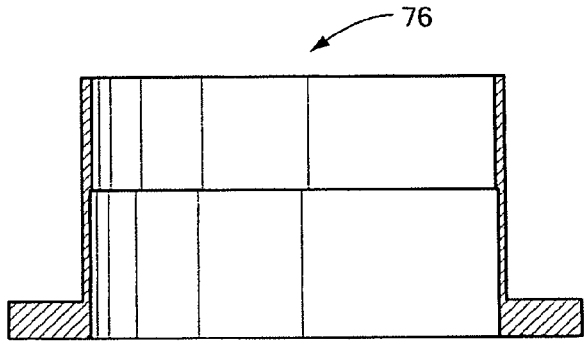
FIG. 9B is a schematic cross sectional view of the outer cone holder component shown in FIG. 9A.
Figure 10:
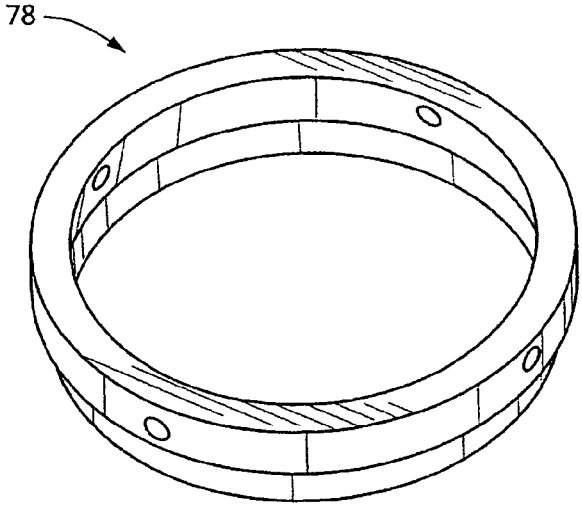
FIG. 10 is a schematic three dimensional top view of the bushing component shown in FIG. 4.
Figure 11:
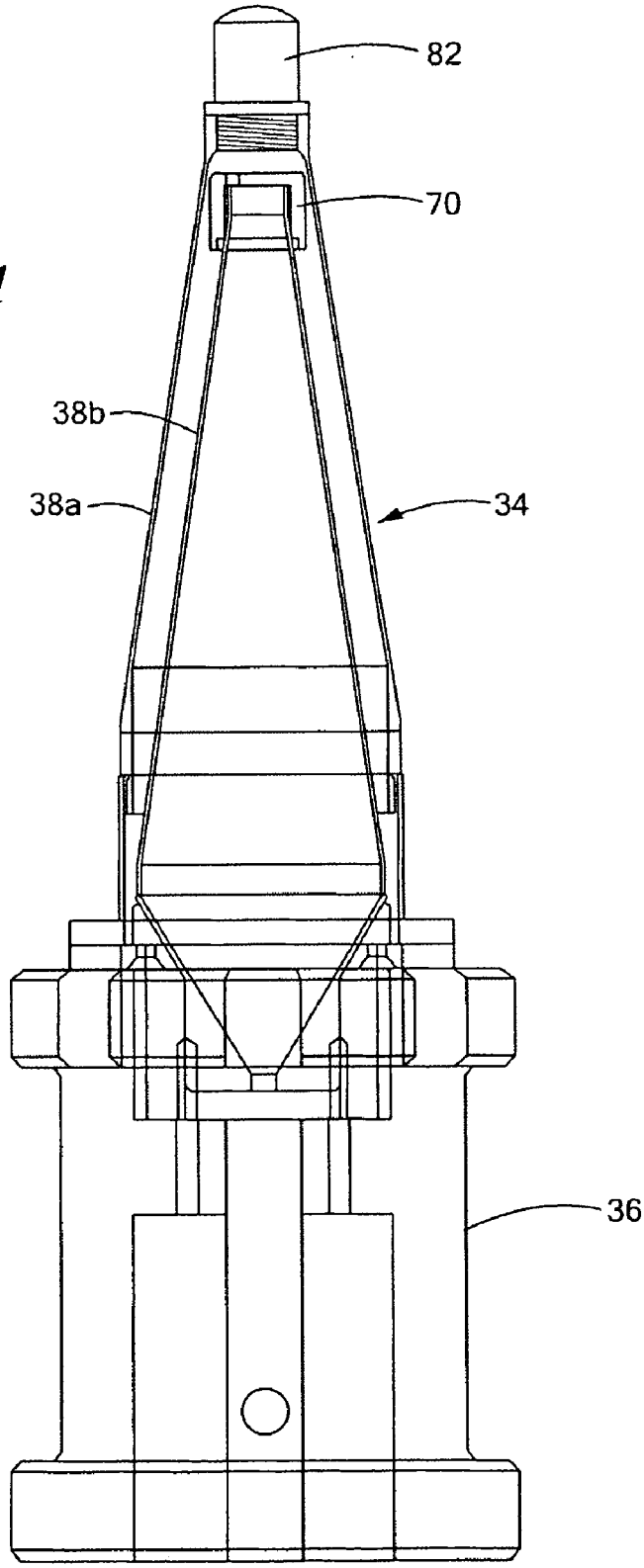
FIG. 11 is a schematic cross sectional view showing the surrogate RPG of FIG. 4 mounted to a sabot in accordance with an example of the subject invention.
Figure 12:
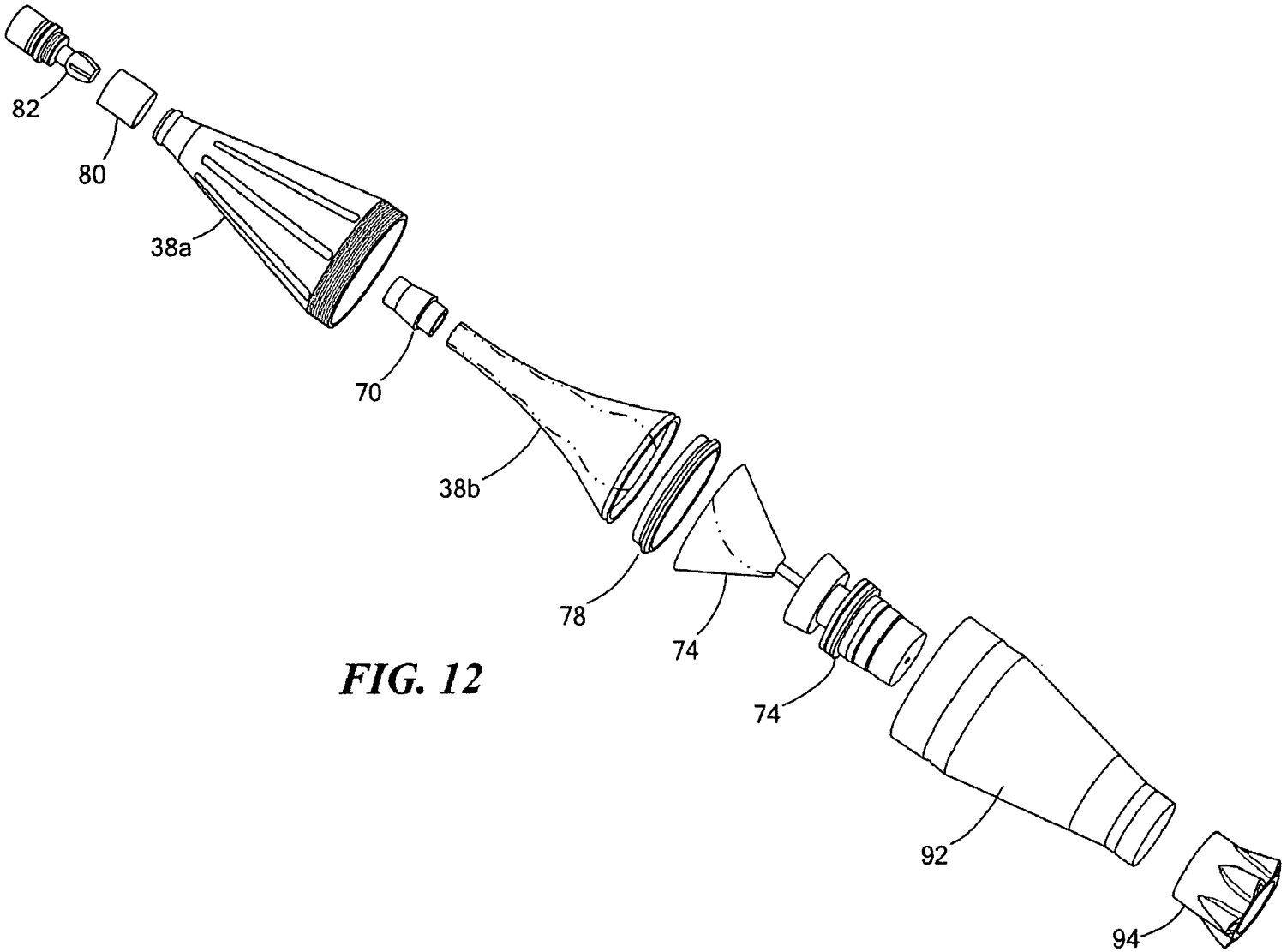
FIG. 12 is a schematic exploded view of another surrogate RPG.

FIG. 4 depicts a cross sectional view of a particular example of a surrogate RPG in accordance with the invention. Insulative spacer 70 is shown between outer cone 38*a* and inner cone 38*b*. Inner cone 38*b* is supported by support structure including inner cone supporter 72. Liner 74 is also shown. Outer cone holder 76 supports outer cone 38*a* and is coupled to inner cone supporter 72. Bushing 78 is also shown. A dummy RPG fuse may be placed in cavity of 80 of outer cone 38*a*. FIG. 5 shows more clearly outer cone 38*a* including markings thereon as discussed above. Inner cone 38*b* is also shown in FIG. 6. Inner cone supporter 72 is shown in FIGS. 7A and 7B; liner 74 is shown in FIGS. 8A and 8B; outer cone holder 76 is shown in FIGS. 9A and 9B; and bushing 78 is shown in FIG. 10. FIG. 11 again shows the various components of the RPG including dummy fuse 82 and the RPG warhead attached to sabot 36. The reusable sabot, FIG. 2 is typically configured to house the outer cone, to serve as a module compatible with the air cannon, and houses the electrical indicating circuitry. To model different threats (e.g., RPG −7, RPG −7M), the configuration of the outer and inner cone may change. In FIG. 12, a base 90 is added which threads into outer cone 38*a*. Also shown are fuse bushing assembly 92 and rocket nozzle 94. A sabot which may reside on base 90, for example, is not shown. The idea here is a more realistic RPG which includes a base portion similar to an actual RPG, maybe even a shaft as well.

Although specific features of the invention are shown in some drawings and not in others, however, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A surrogate RPG for testing the effectiveness of an RPG defeat technology comprising:

a warhead including:

an outer conductive portion, and an inner conductive portion spaced from the outer conductive portion; and a sabot including an electrical circuit configured to:

monitor conductivity between the inner and outer conductive portions; and indicate a defeat of said RPG and the effectiveness of said RPG defeat technology.

2. The surrogate RPG of claim 1 in which the electrical circuit includes a power source electrically connected to the outer and inner conductive portions via an indicator.

3. The surrogate RPG of claim 2 in which the indicator includes at least one lamp.

4. The surrogate RPG of claim 1 in which the outer conductive portion is cone shaped and the inner conductive portion is cone shaped.

5. The surrogate RPG of claim 4 in which the outer cone shaped conductive portion includes markings dividing the outer conductive cone shaped portion into sections.

6. The surrogate RPG of claim 1 further including an insulative spacer between the outer conductive portion and the inner conductive portion.

7. The surrogate RPG of claim 1 further including a support structure for the outer conductive portion.

8. The surrogate RPG of claim 1 further including a support structure for the inner conductive portion.

9. The surrogate RPG of claim 1 further including a dummy fuse attached to the outer conductive portion.

10. The surrogate RPG of claim 1 further including a base section coupled to the outer conductive portion.

11. The surrogate RPG of claim 1 in which the RPG defeat technology includes a shield.

12. A surrogate RPG comprising:

a warhead including:

an outer conductive portion, and an inner conductive portion spaced from the outer conductive portion; and an electrical circuit configured to monitor conductivity between the inner and outer conductive portions without igniting said RPG.

13. The surrogate RPG of claim 12 further including a sabot housing the electrical circuit.

14. A surrogate RPG comprising:

a warhead including:

a replaceable outer conductive portion, and a replaceable inner conductive portion;

a reusable sabot attached to the warhead; and an electrical circuit configured to monitor conductivity between the inner and outer conductive portions, the electrical circuit including a power source electrically connected to the outer and inner conductive portions via an indicator.

15. The surrogate RPG of claim 14 in which the RPG defeat technology includes a shield.

16. A method of making a surrogate RPG, the method comprising:

fabricating an outer conductive warhead portion;

fabricating an inner conductive warhead portion;

placing the inner conductive warhead portion inside the outer conductive warhead portion in a spaced relationship with respect to the outer conductive warhead portion; and installing an electrical circuit configured to monitor conductivity between the inner and outer conductive portions including electrically connecting a power source to the outer and inner conductive portions via an indicator including at least one lamp.

17. A method of evaluating the effectiveness of an RPG shield, the method comprising:

firing a surrogate RPG at an RPG shield, the surrogate RPG including an outer conductive portion spaced from an inner conductive portion and an electrical circuit;

configuring the electrical circuit to monitor conductivity between the inner and outer conductive portions to indicate whether or not the RPG was defeated;

imaging the firing of a surrogate RPG as it strikes the RPG shield; and reviewing the resultant images to determine if conductivity between the inner and outer conductive portions changed during the firing.

* * * * *